US007826772B2

(12) United States Patent
Hirobe et al.

(10) Patent No.: US 7,826,772 B2
(45) Date of Patent: Nov. 2, 2010

(54) IMAGE FORMING APPARATUS USING COLOR TONER AND TRANSPARENT TONER

(75) Inventors: Fumitake Hirobe, Ushiku (JP); Yuichiro Toyohara, Fujisawa (JP); Tatsuomi Murayama, Toride (JP); Akihiro Noguchi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/537,375

(22) Filed: Aug. 7, 2009

(65) Prior Publication Data

US 2009/0317139 A1 Dec. 24, 2009

Related U.S. Application Data

(62) Division of application No. 11/466,600, filed on Aug. 23, 2006, now Pat. No. 7,596,345.

(30) Foreign Application Priority Data

Aug. 31, 2005 (JP) ..... 2005-251658

(51) Int. Cl.
*G03G 15/08* (2006.01)

(52) U.S. Cl. ..... 399/223; 399/227; 430/123.51

(58) Field of Classification Search ..... 399/54, 399/223, 226, 227, 228, 252, 299, 302, 303; 430/123.51
See application file for complete search history.

(56) References Cited

U.S. PATENT DOCUMENTS

| | | | |
|---|---|---|---|
| 5,073,793 | A | 12/1991 | Fujiwara et al. |
| 6,327,450 | B1 | 12/2001 | Ito |
| 6,996,358 | B2 | 2/2006 | Ayaki et al. |
| 7,110,686 | B2 | 9/2006 | Toyohara |
| 7,113,729 | B2 | 9/2006 | Toyohara |
| 7,120,368 | B2 | 10/2006 | Toyohara |

(Continued)

FOREIGN PATENT DOCUMENTS

| | | | |
|---|---|---|---|
| JP | 6-332232 | A | 12/1994 |

(Continued)

*Primary Examiner*—Robert Beatty
(74) *Attorney, Agent, or Firm*—Fitzpatrick, Cella, Harper & Scinto

(57) ABSTRACT

An image forming apparatus includes a developing apparatus for developing an electrostatic image with a developer comprising at least a toner and a first external additive, the developing apparatus including a plurality of developing devices, containing toners different in color or lightness from each other, in which at least two developing devices contain a dark color toner and a light color toner which have an identical hue and different lightnesses and the developing device containing the light color toner is subjected to a developing operation prior to another developing device; a first transfer apparatus for sequentially transferring toner images, which have been developed by the plurality of developing devices, onto an intermediary transfer member; and a second transfer apparatus for transferring the toner images from the intermediary transfer member all together onto a transfer medium The first external additive includes particles having an aspect ratio of not less than 1.0 and not more than 1.5 and a number-average particle size of not less than 0.06 μm and not more than 0.3 μm, and has a coverage thereof with respect to the light color toner larger than that with respect to the dark color toner in a transferred state on the intermediary transfer member.

6 Claims, 8 Drawing Sheets

U.S. PATENT DOCUMENTS

| | | | |
|---|---|---|---|
| 7,277,649 | B2 | 10/2007 | Hirobe et al. |
| 2007/0059056 | A1 | 3/2007 | Murayama et al. |

FOREIGN PATENT DOCUMENTS

| | | | |
|---|---|---|---|
| JP | 6-332235 | A | 12/1994 |
| JP | 7-181732 | A | 7/1995 |
| JP | 2000-29241 | A | 1/2000 |
| JP | 2000-231279 | A | 8/2000 |
| JP | 2000-267346 | A | 9/2000 |
| JP | 2001-117265 | A | 4/2001 |
| JP | 2005-107066 | A | 4/2005 |

IMAGE FORMING APPARATUS USING COLOR TONER AND TRANSPARENT TONER

This application is a divisional of U.S. patent application Ser. No. 11/466,600, filed Aug. 23, 2006.

FIELD OF THE INVENTION AND RELATED ART

The present invention relates to an image forming apparatus, employing an electrophotographic method, such as a copying machine or a printer.

Demands for color image formation, particularly on-demand printing have conventionally grown, so that an intermediary transfer method such that multicolor images are formed on an intermediary transfer member and are transferred all together onto an image fixing material so as to meet high-speed image formation and a variety of transfer materials have been frequently used. In this method, transfer is repeated in such a manner that a toner image is superposed on the intermediary transfer member or a previous toner image, so that there has been known that a toner image which has been already transferred onto the intermediary transfer member is reversely transferred (re-treated onto a photosensitive drum during subsequent transfer operations). For example, in the case of forming a red image, a yellow solid image is formed first on the intermediary transfer member and thereon a magenta solid image is multilayer-transferred. Thereafter, during transfer of images of cyan and black, multilayer transfer is effected in such a state that there is no toner to be transferred onto the intermediary transfer member. In this case, during the transfer of images of cyan and black, the yellow toner and the magenta toner which have been transferred onto the intermediary transfer member are electrostatically absorbed by the intermediary transfer member. On the other hand, when the intermediary transfer member passes through a spacing between a transfer drum and each of the photosensitive drums for cyan and black, the magenta toner contacts the photosensitive drum, so that a part of the magenta toner on the intermediary transfer member is re-transferred onto the photosensitive drum.

As a result, at a portion where the magenta toner is re-transferred, a density of magenta toner image is lowered, so that a color of yellow toner image which has been previously transferred onto the intermediary transfer member and located under the magenta toner image is intensified to considerably deteriorate image quality. In other words, there arises problems such as an irregularity of image, a lowering in density, and a deviation of color balance.

Further, during a secondary transfer step for transferring four color toners transferred onto the intermediary transfer member onto a transfer material at a time, a transfer efficiency of toner of the lowermost layer on the intermediary transfer member is generally lower than that of toner of the uppermost layer. This phenomenon is more noticeable by a change in charge amount of toner and a change in resistance of the transfer material due to a change in temperature and humidity.

Further, development and commercialization of small particle size toner for the purpose of faithful reproduction have advanced, so that a further improvement of transfer efficiency is important.

As one method of improving a transferability of toner, a method in which a shape of toner is caused to be close to spherical shape is performed in recent years. For example, such a method may include a process for producing a polymerization toner through suspension polymerization or emulsion polymerization, sphere formation by hot blast (e.g., as described in Japanese Laid-Open Patent Application (JP-A) 2000-029241), and sphere formation by mechanical impact force (e.g., as described in JP-A Hei 07-181732). These methods are very effective means for improving toner transfer ability. However, in the case of using the polymerization toner production process, a higher transfer efficiency can be obtained as the toner shape is closer to a true sphere but cleaning latitude is decreased. Further, in the case of forming a sphere of pulverization toner through hot blast or mechanical impact force, a release agent contained in toner is more liable to migrate to the toner surface as the sphere formation advances. As a result, a flowability of the toner is lowered, so that development and transfer characteristics are impaired.

In view of these circumstances, in order to efficiently use the toner improved in sphericity, a shape or composition of inorganic fine particles is required to be controlled. For example, in JP-A Hei 06-332232 and JP-A 2000-267346, a degree of deposition of the inorganic fine particles on the toner is controlled by defining an aspect ratio to control transferability and chargeability. JP-A Hei 06-332235 discloses electrophotographic toner comprising toner particles and at least two species of external additives. More specifically, a first external additive as an average particle size of 0.1-0.5 μm on the basis of number of primary particles, and a second external additive has an average particle size of at most 20 nm on the basis of number of primary particles and is hydrophobic.

Further, in recent years, as means for providing high quality image, JP-A 2000-231279 has proposed an electrophotographic image forming apparatus such that the number of colors of developer is increased compared with a conventional four-color image forming apparatus. In a preceding ink jet method, an image forming system using ordinary toners of pale cyan and pale magenta has been disclosed. According to this variable density type image forming system, it is possible to provide an image, with good graininess, which exhibits less edge enhancement and less fluctuation in color by forming an image with light color toner prepared in such a manner that a covering power thereof is lower than that of dark color toner.

The light color toner has a property such that it is difficult to visually recognize the fluctuation in color or color shift, so that light color toner image formation may preferably be effected prior to dark color toner image formation. Further, the light color toner is prepared by using a smaller amount of coloring particles (pigment) than the dark color toner, so that a toner resin characteristic of the light color toner is liable to be exhibited compared with the dark color toner. The toner resin currently used for color image formation comprises polyester-type resin in many cases in view of chargeability, fixability, etc., so that a resultant resin charge characteristic is negative chargeability. For this reason, the charge characteristic of the light color toner which uses a smaller amount of pigment is more negative compared with that of the dark color toner in many cases.

As described above, in a six-color image forming apparatus using the pale and dark color toners, the light color toner may preferably be provided at first and second image forming stations. However, compared with the dark color toner, the light color toner has a larger charge amount, so that a primary transfer efficiency is decreased. The transfer efficiency is further decreased by the influence of re-transfer five times at the most in subsequent transfer steps. Further, at a secondary transfer portion, the light color toner constitutes the first and second toner layers formed on an intermediary transfer member, so that a secondary transfer efficiency is decreased and a transfer characteristic is considerably lowered.

As a result, an amount of the light color toner which has been transferred first is decreased by the transfer, thus inviting such a problem that the color of a final image is changed.

Accordingly, in the image forming apparatus employing the pale and dark color toners, compared with an image forming apparatus having a conventional constitution, a transfer efficiency of the first light color toner image is required to be higher than other toner images.

SUMMARY OF THE INVENTION

An object of the present invention is to provide an image forming apparatus capable of providing a stable image, by improving a transfer efficiency of a light color toner image which has been first subjected to developing operation, while taking a balance with toner images which are developed after the first developing operation.

According to an aspect of the present invention, there is provided an image forming apparatus, comprising:

a developing apparatus for developing an electrostatic image with a developer comprising at least a toner and a first external additive, the developing apparatus including a plurality of developing devices, containing toners different in color or lightness from each other, in which at least two developing devices contain a dark color toner and a light color toner which have an identical hue and different lightness and the developing device containing the light color toner is subjected to a developing operation prior to another developing device;

a first transfer apparatus for sequentially transferring toner images, which have been developed by the plurality of developing devices, onto an intermediary transfer member; and a second transfer apparatus for transferring the toner images from the intermediary transfer member all together onto a transfer medium, wherein the first external additive comprises particles having an aspect ratio of not less than 1.0 and not more than 1.5 and a number-average particle size of not less than 0.06 μm and not more than 0.3 μm, and has a toner coverage thereof with respect to the light color toner larger than that with respect to the dark color toner in a transferred state on the intermediary transfer member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, with reference to the drawings, an image forming apparatus according to the present invention will be described.

First Embodiment

Figure 1:
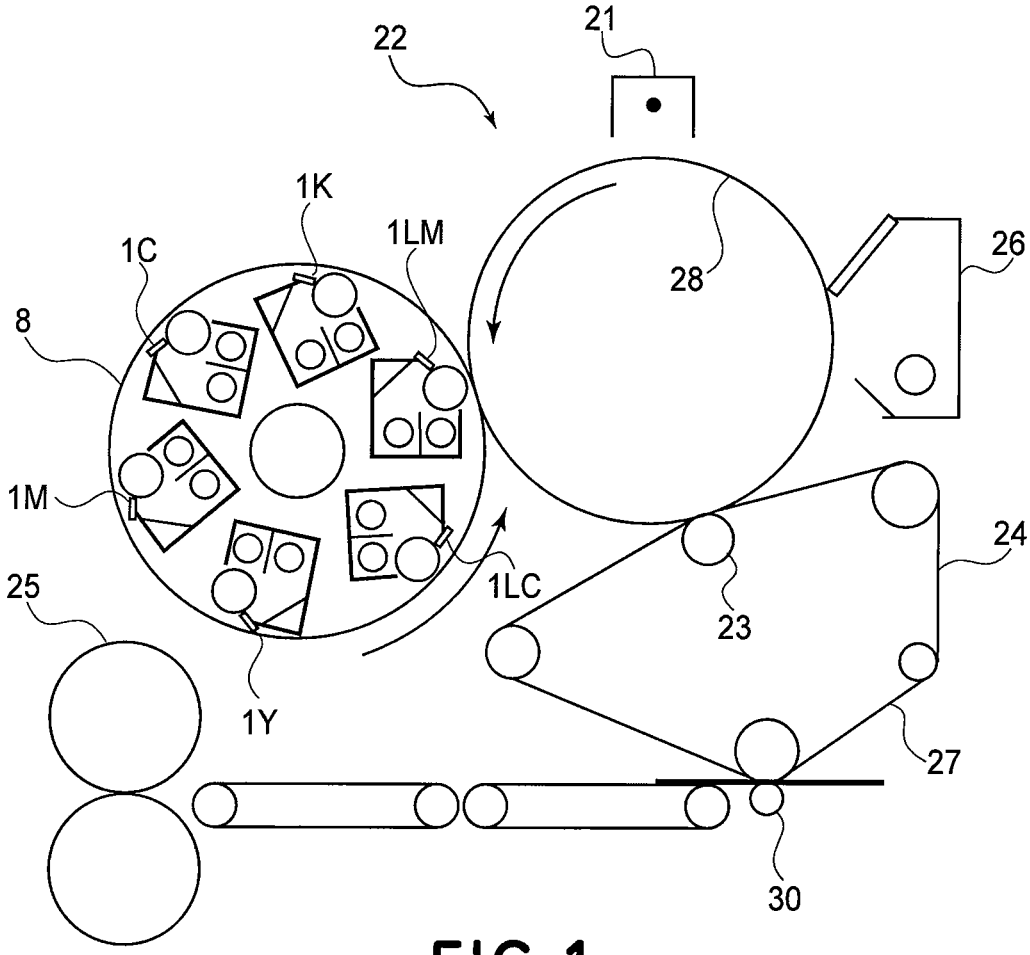
FIG. 1 is a schematic view for illustrating an image forming apparatus in a First Embodiment according to the present invention.

FIG. 1 is a schematic view for illustrating an image forming apparatus according to this embodiment.

First, an operation of an entire image forming apparatus that a rotary developing apparatus 8 is rotatably supported around a photosensitive drum 28 as an image bearing member is employed. The rotary developing apparatus 8 includes six developing devices 1LM, 1LC, 1Y, 1M, 1C and 1K, which contain light magenta toner, light cyan toner, yellow toner, magenta toner, cyan toner and black toner, respectively.

An electrostatic image is formed on the photosensitive drum 28 by exposing the surface of the photosensitive drum electrically charged by a charger 21 to light with a laser 22. Then, the rotary developing apparatus 8 is rotated in a direction of an arrow, so that a predetermined developing device 1LM is moved to a developing portion. At the developing portion, the developing device 1LM is actuated to develop the electrostatic image with toner, thus forming a toner image on the photosensitive drum 28.

Thereafter, the toner image formed on the photosensitive drum 28 is transferred onto an intermediary transfer belt 24 by a transfer bias applied from a primary transfer roller 23 as a primary transfer means. Then, similarly, color toner images are developed by the developing devices 1LC, 1Y, 1M, 1C and 1K in this order and are successively transferred onto the previous toner image in a superposition manner, thus forming a full-color toner image.

The toner image of six colors formed on the intermediary transfer belt 24 is transferred onto a transfer medium (recording paper) 27 by a secondary transfer charger 30 and then is fixed under pressure and heating by a fixing device 25 to obtain a permanent image. Further, residual toner remaining on the photosensitive drum 28 after the transfer is removed by a cleaner 26.

Two-component developer used in this embodiment will be described more specifically.

In this embodiment, toner is prepared by kneading a resinous binder principally comprising polyester with a pigment and subjecting the kneaded product to pulverization and classification to obtain toner particles having a volume-average particle size of approximately 5 μm. A carrier is prepared by coating a core principally comprising ferrite with a layer of silicone resin to have a 50%-particle size ($D_{50}$) of 40 μm. The thus prepared toner and carrier are mixed in a weight ratio of approximately 8:92 to provide a two-component developer having a toner concentration (TD ratio) of 8%.

A light color toner is a toner in which a colorant is internally added so as to provide an optical density of less than 1.0 per 0.5 mg/cm$^2$ of an amount of the toner on a transfer medium. Further, a dark color toner is a toner in which a colorant is internally added so as to provide an optical density of not less than 1.0 per 0.5 g/cm$^2$ of an amount of the toner on a transfer medium. In this embodiment, the optical density per 0.5 g/cm$^2$ of the toner amount on the transfer medium is adjusted to 0.8 for the light color toner and 1.6 for the dark color toner by internally adding an appropriate amount of pigment (colorant) in a toner base material. In this embodiment, the amount of pigment for the light color toner is set to be ⅕ of that of pigment for the dark color toner.

In this embodiment, on the toner surface, an aspect ratio (ratio of long axis to short axis) is 1.0 to 1.5, and inorganic fine particles (A) having a number-average particle size of not less than 0.06 and less than 0.30 μm and inorganic fine particles (B) having a number-average particle size of not less than 0.01 μm and less than 1.06 μm are used as the external additive.

The aspect ratio on the toner surface and the number-average particle size of the inorganic fine particles are obtained from an electron micrograph. As described above, the number-average particle size of the inorganic fine particles is 0.06-0.30 μm. In this regard, the number-average particle size may preferably be 0.07-0.20 μm, and more preferably be 0.08-0.15 μm. When the number-average particle size is less than 0.06 μm, the inorganic fine particles function less as a spacer and contribute less to an improvement in transferability. On the other hand, when the number-average particle size is more than 0.3 μm, the inorganic fine particles are more liable to be detached from the toner, so that they are not readily deposited stably on the surface of toner base material and thus a transfer efficiency is lowered. Further, the inorganic fine particles are detached from the toner during development to contaminate the periphery of the developing devices, and the detached inorganic fine particles are deposited on the photosensitive drum, the carrier, etc., so that deterioration in charge performance is caused to occur.

Further, when the aspect ratio exceeds 1.5, the shape of the toner becomes distorted (flat shape). In such a case, the toner is present so that it contacts the inorganic fine particles at its flat surface because of stability thereof. As a result, a length of inorganic fine particle in a short axis direction contributes to a spacer effect. However, due to the flat shape of the toner, the length of inorganic fine particle in the short axis direction is a small value, so that a sufficient spacer effect cannot be achieved. Incidentally, the aspect ratio cannot be less than 1.0 because of its definition.

Further, the inorganic fine particles (B) has a number-average particle size of not less than 0.01 μm and less than 0.06 μm, preferably 0.01-0.05 μm, on the toner surface. The inorganic fine particles (B) may also be surface-treated with a silane compound or a coupling agent. When the number-average particle size is less than 0.01 μm, the inorganic fine particles (B) are liable to be embedded into the toner surface during long-term use, so that a physical deposition force of the toner is increased to impair a transferability. On the other hand, when the number-average particle size exceeds 0.06 μm, an effect of imparting flowability is decreased, so that a charge characteristic is liable to be unstable.

It is preferable that the inorganic fine particles (A) and the inorganic fine particles (B) are used together in terms of improvements in flowability and chargeability. Because of the flowability-imparting effect of the inorganic fine particles (B), electric charging of the toner in developing device is sufficiently effected, so that it is effective to prevent fog and toner scattering. This effect is particularly noticeable in a high temperature/high humidity (H/H) environment. Further, generally, when the toner is left standing in the H/H environment, an absolute charge amount is lowered. As a result, in some cases, an image density required for the time of rise after the standing is also not obtained. The use of the inorganic fine particles (A) and (B) in combination is also effective to solve this problem.

Further, by controlling an average circularity of the toner so as to be in the range of 0.915-0.960, it is possible to provide toner having less recessed portion. For this reason, the inorganic fine particles externally added in the toner do not enter the recessed portion, so that the spacer effect can be achieved sufficiently. Further, by the addition of the inorganic fine particles (B), the inorganic fine particles (A) are uniformly deposited on the toner surface, so that they can be continuously deposited uniformly on the toner surface without being localized even in long-term use. Actually, when the inorganic fine particles (A) and (B) are added in the toner having an average circularity of 0.915-0.960, the resultant toner is stable in chargeability and decreased in fluctuation of transfer efficiency, even in long-term use.

The inorganic fine particles (A) is spherical or substantially spherical, so that they have a small contact area with the toner base material and move on the toner surface during long-term use to be localized to a site to be predicted that it has a large friction. This has been confirmed by an electron microscopy image of the toner after the long-term use. However, in order to maintain a stable transferability, it is desirable that the inorganic fine particles (A) are uniformly deposited on the toner surface and kept at an initial position even during the long-term use. It is considered that the localization of the inorganic fine particles (A) is prevented by causing the inorganic fine particles (B) to be deposited on the toner surface so that they constitute minute recesses and projections to create an appropriate friction with respect to particles having a size close to that of the inorganic fine particles (A).

In this embodiment, in a mixed state of the inorganic fine particles (A) and the inorganic fine particles (B), they have charge characteristics opposite in polarity to each other. As a result, a deposition force between the external additives is increased, so that it is possible to prevent detachment of the inorganic fine particles (A) having a large particle size from the toner. More specifically, in this embodiment, a charge characteristic series is adjusted so that respective materials have negative chargeability levels on the order of inorganic fine particles (B)>toner base material>inorganic fine particles (A).

Further, it has been confirmed that a further effect is achieved by employing such a two-stage external addition method that the inorganic fine particles (B) are first externally added to the toner prior to the inorganic fine particles (A).

In the present invention, the inorganic fine particles (A) have the aspect ratio (ratio of long axis to short axis) in the range of 1.0 to 1.5 and the number-average particle size of 0.06-0.30 μm. Examples of the inorganic fine particles (A) may include fine particles of silica, alumina, titanium oxide, etc. Compositions of these materials are not particularly limited. For example, in the case of silica, it is possible to use fine particles of silica produced by any conventionally known methods such as vapor-phase decomposition, combustion method, deflagration method, etc. Particularly, alkoxysilane is hydrolyzed and subjected to condensation reaction in an organic solvent in the presence of water to obtain a silica sol suspension, followed by removal of the solvent, drying, and formation of particles to prepare fine particles of silica. The thus obtained silica fine particles, through the known sol-gel method, having a number-average particle size of 0.06-0.30 μm may preferably be used. Further, the surfaces of silica fine particles obtained through the sol-gel method may be subjected to hydrophobicity-imparting treatment. As a hydrophobicity-imparting agent, a silane compound may preferably be used. Examples of the silane compound may include: monochlorosilanes, such as hexamethyldisilazane, trimethylchlorosilane, and triethylchlorosilane; monoalkoxysilanes, such as trimethylmethoxysilane and trimethylethoxysilane; monoaminosilanes, such as trimethylsilyldimethylamine and trimethylsilyl-diethylamine; and monoacryloxysilanes, such as trimethylacetoxysilane. In the present invention, the inorganic fine particles (A) may be added in the toner in an amount of 0.3-5.0 weight parts, preferably 0.5-3.0 weight parts, per 100 wt. parts of the toner base material particles.

In the present invention, examples of the inorganic fine particles (B) may include fine particles of various inorganic compounds including: metal compounds, such as aluminum oxide, titanium oxide, strontium titanate, cerium oxide, magnesium oxide, chromium oxide, tin oxide, and zinc oxide; nitrides, such as silicon nitride; carbides, such as silicon carbide; metal salts, such as calcium sulfate, barium sulfate, and calcium carbonate; aliphatic acid metal salts, such as zinc stearate and calcium stearate; carbon black; and silica. In a preferred embodiment, hydrophobic titanium oxide fine particles and/or hydrophobic silica fine particles may be added. The addition of the hydrophobic titanium oxide fine particles is effective to stabilize chargeability. Further, by the addition of the hydrophobic silica fine particles, it is possible to impart flowability to toner and to provide toner with an appropriate amount of electric charge because of high negative chargeability. The inorganic fine particles (B) may be added in the toner in an amount of 0.1-5.0 weight parts, preferably 0.1-1.5 weight parts, per 100 weight parts of the toner base material particles.

A long axis diameter, a short axis diameter, and a number-average particle size of the inorganic fine particles (A) and a number-average particle size and toner coverage due to an external additive of the inorganic fine particles (B) are measured in the following manner in the present invention.

Figure 8:
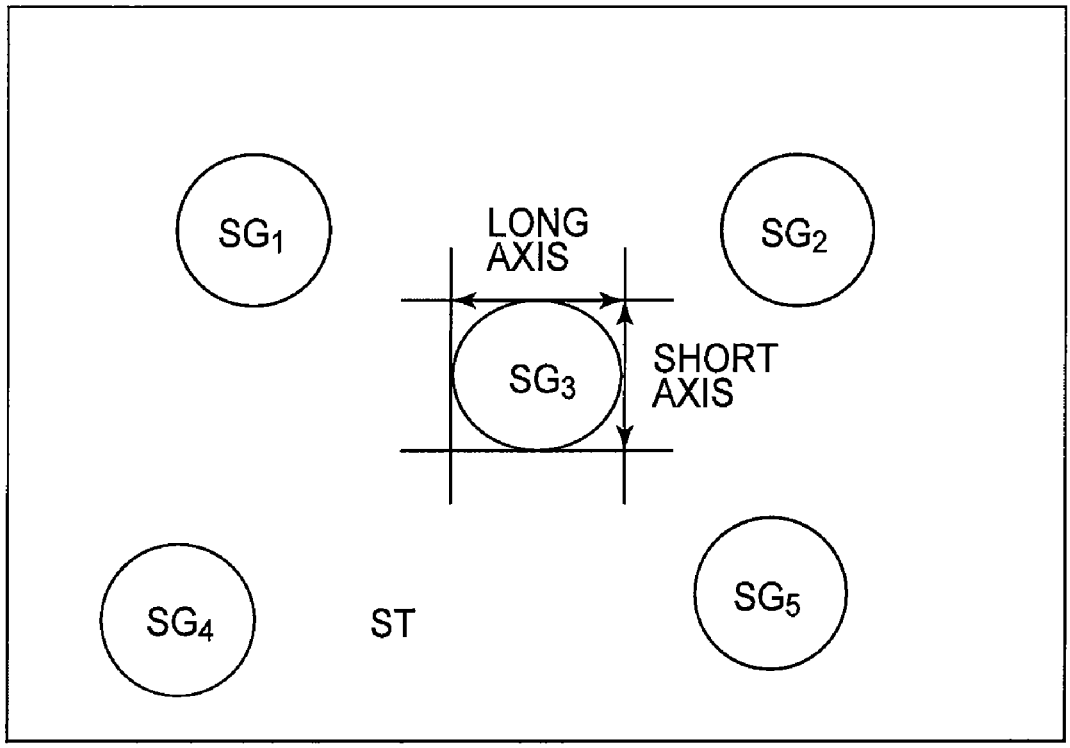
FIG. 8 is a schematic view for illustrating a method of calculating an aspect ratio and toner coverage due to an external additive in the present invention.

The surface of toner is subjected to observation through a field emission-scanning electron microscope (FE-SEM) ("S-800", mfd. by Hitachi, Ltd.) and image analysis of a resultant micrographic image. The aspect ratio is obtained from the FE-SEM photographic image by measuring a maximum diameter of particle (long axis diameter) and a minimum diameter of particle (short axis diameter) in a direction perpendicular to a direction of the long axis. Ratios of the long axis diameter to the short axis diameter with respect to respective particles are calculated, and an average of the calculated values is defined as an aspect ratio of the inorganic fine particles (A). From the electron microscope photograph, 50 to 100 inorganic fine particles having an aspect ratio of 1.0 to 1.5 are randomly chosen as samples. With respect to spherical particles, their diameters are taken as particle sizes, and with respect to elliptically spherical particles, lengths in a certain direction are taken as particle sizes. From these particle sizes, an average thereof is obtained to calculate a number-average particle size. Also with respect to the inorganic fine particles (B), from a photographic image taken under the same condition, 50 to 100 inorganic fine particles are chosen as samples from agglomerated particles including particles and grain boundaries which are not less than 0.01 μm and less than 0.06 μm in terms of a number-average particle size. With respect to spherical particles, there diameters are taken as particle sizes, and with respect to elliptically spherical particles, lengths in a certain direction are taken as particle sizes. From these particle sizes, an average thereof is obtained to calculate an number-average particle size. Further, toner coverage due to an external additive is defined and obtained as a ratio of a projection area of the inorganic fine particles (A) or the inorganic fine particles (B) onto the toner surface per unit area. (In order to distinguish between projection areas, a suffix "n", which is an integer, is added to SG. Accordingly, "SGn" refers to a projection area of the n-th sample.) More specifically, 100 toner images are randomly chosen as samples by using the scanning electron microscope (FE-SEM (S-800)) and image information thereof is inputted into an image analyzer ("Luzex 3", mfd. by Nireco Co.) through an interface to be calculated. FIG. 8 shows a state of image information data inputted into the image analyzer. The image information is converted into binary (two-valued) data since the toner particle is different in lightness between a surface portion and an external additive portion and an area ST of the toner particle portion (including the external additive portion). The toner coverage due to an external additive is calculated according to the following equation:

$$\text{Toner coverage due to an external additive (\%)} = (\Sigma SGn)/ST \times 100$$

In this embodiment, the toner coverage due to an external additive is calculated for each of the inorganic fine particles (A) and the inorganic fine particles (B).

Further, as a characteristic feature of the present invention, the toner coverage due to an external additive is measured and determined with respect to toner transferred onto the intermediary transfer belt (member) 24. This is because an effect of the toner coverage due to an external additive with respect to the toner on the intermediary transfer member 24 is large in terms of improvement in transfer characteristic of a first developing toner image constituting a lowermost layer during secondary transfer. Next, a measuring method employed in this embodiment will be described specifically. First, a first developing (light) toner image developed on the photosensitive drum 28 as a solid black image is primary-transferred onto the intermediary transfer member 24. Then, second to sixth developing toner images are subjected to development as solid white images. As a result, with respect to the first developing toner image, a maximum (five) retransfer state is created. When the final (sixth) developing toner image is transferred onto the intermediary transfer member 24, the image forming apparatus is forcibly stopped, and the first developing toner image transferred onto the intermediary transfer member 25 is taken as a sample by scraping it off the intermediary transfer member 24 with a cleaner blade. As the sampling method, it is also possible to use a method in which the toner image is recovered by causing the magnetic carrier to contact the toner image. Next, the sixth developing (dark) toner image developed on the photosensitive drum 28 as the solid black image is transferred onto the intermediary transfer member 24. In this state, the image forming apparatus is stopped and the sixth developing toner image is similarly taken as a sample. Then, toner coverages due to an external additive of the thus obtained first and sixth developing toner images on the intermediary transfer member 24 are compared. The toner coverages are calculated by the above-described method using the FE-SEM. In this embodiment, the first and sixth developing toner images are representatively used as the light color toner image and the dark color toner image but other developing toner images may also be employed for the comparison of toner coverage.

In the present invention, an average circularity is used for simply representing a shape of particle in a quantitative manner. More specifically, a flow-type particle image analyzer ("FPIA-2100", mfd. by SYSMEX Corp.) is employed for measurement in the present invention.

A method of externally adding the inorganic fine particles is as follows.

Classified toner particles, the above-described inorganic fine particles (A), and as needed, the above-described inorganic fine particles (B) and other known external additives are formulated in predetermined amounts. Thereafter, by using a high-speed mixer, such as Henshel mixer or SUPER MIXER, as an external adding machine, external addition is performed.

Next, characteristic features of this embodiment will be described.

In this embodiment, sol-gel silica fine particles are used as the inorganic fine particles (A) and titanium oxide fine particles are used as the inorganic fine particles (B).

In 100 weight parts of toner base material particles, 1.0 weight part of the inorganic fine particles (A) and 0.5 weight part of the inorganic fine particles (B) are added.

Characteristics of the inorganic fine particles (A) and (B) are shown in Table 1.

TABLE 1

| Inorganic fine particles | Primary particle size | Aspect ratio | External additive coverage |
|---|---|---|---|
| (A) | 120 nm | 1.2 | 12% |
| (B) | 40 nm | 1.4 | 36% |

Further, toner charge amounts (triboelectric charges Tc) (mC/g) at respective color image forming stations are shown in Table 2.

TABLE 2

| Tc | LM | LC | Y | M | C | K |
|---|---|---|---|---|---|---|
| (mC/kg) | 35 | 35 | 30 | 30 | 30 | 30 |

From the results shown in Table 2, it is understood that the light color toners provide the triboelectric charge (Tc) higher than those of the dark color toners by 5 (mC/kg).

The triboelectric charges (Tc) of the respective toners are measured in the following manner.

In a metal-made measuring container having a 30 μm-aperture (500 mesh) at a bottom, ca. 0.5 to 1.5 g of a two-component developer taken as a sample from a developing sleeve is placed and a metal lid is put on the measuring container. At this time, the entire measuring container is weighed at W1 (g). Then, the measuring container is subjected to suction through a suction port sufficiently, preferably for 2 minutes. A potential at this time is measured as V (volts). The measuring container is a capacitor having a capacitance C (mF). After the suction, the entire measuring container is weighed at W2 (g). The triboelectric charge (Tc) of this sample is calculated according to the following equation:

$$Tc(mC/kg)=C\times V/(W1-W2)$$

The measurement is effected in an environment of 23° C. and 50% RH.

Figure 2:
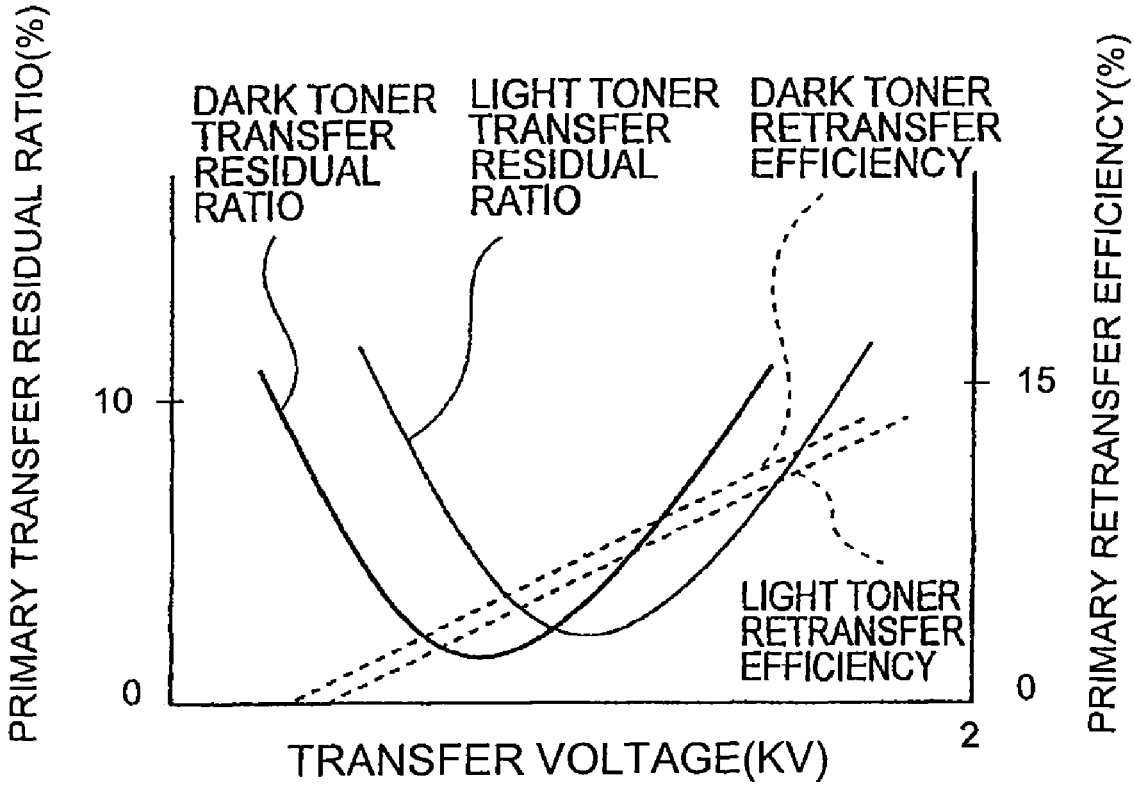
FIG. 2 is a graph for illustrating a primary transfer characteristic in the First Embodiment of the present invention.

Primary transfer characteristics of the light color toner and the dark color toner are shown in FIG. 2.

In FIG. 2, transfer efficiency curves of the light color toner and the dark color toner with respect to a transfer voltage when the toners are transferred from the photosensitive drum 28 onto the intermediary transfer belt 24 are shown. In the figure, a left ordinate represents a primary transfer residual ratio (%) calculated from an amount of toner (or image density) on the photosensitive drum 28 before and after the primary transfer. When a density of toner image on the photosensitive drum before the primary transfer is A and a density thereof after the primary transfer is B, the primary transfer residual ratio is obtained by (A−B)/A×100. In the figure, a lowest point represents a maximum transfer efficiency.

In FIG. 2, a retransfer efficiency characteristic, of the dark color toner and the light color toner retransferred from the intermediary transfer belt 24 to the photosensitive drum 28 occurring at a downstream image forming station, with respect to a transfer voltage is also shown. In the figure, a right ordinate represents the primary retransfer efficiency calculated in the following manner. For example, in the case of yellow (Y) toner, first, a solid black image of Y toner is formed and transferred onto the intermediary transfer belt. An amount (or density) of the toner image on the intermediary transfer belt is measured as B. Next, a solid white image is formed and then an amount (or density) of the Y toner image retransferred from the intermediary transfer belt to the photosensitive drum after the transfer is measured as C. The primary retransfer efficiency (%) is obtained by C/B×100.

As understood from the results shown in FIG. 2, in the case where the transfer voltage is applied to the surface of the photosensitive drum 28 on which the toner image is developed, a transfer characteristic is such that a transfer current starts to flow with transfer of the toner image to increase a transfer efficiency which has an inflection point at a certain voltage and then starts to decrease. At the inflection point (i.e., a peak position of the transfer efficiency), it is found that a necessary transfer current is changed by triboelectric charge.

On the other hand, it is also found that there is no large difference in retransfer efficiency (characteristic) between the light color toner and the dark color toner. Accordingly, in order to maximize the transfer efficiency of the light color toner, the transfer voltage is required to be increased. However, the retransfer efficiency thereof also worsens. As a result, a utilization efficiency is considerably worse.

Figure 3:
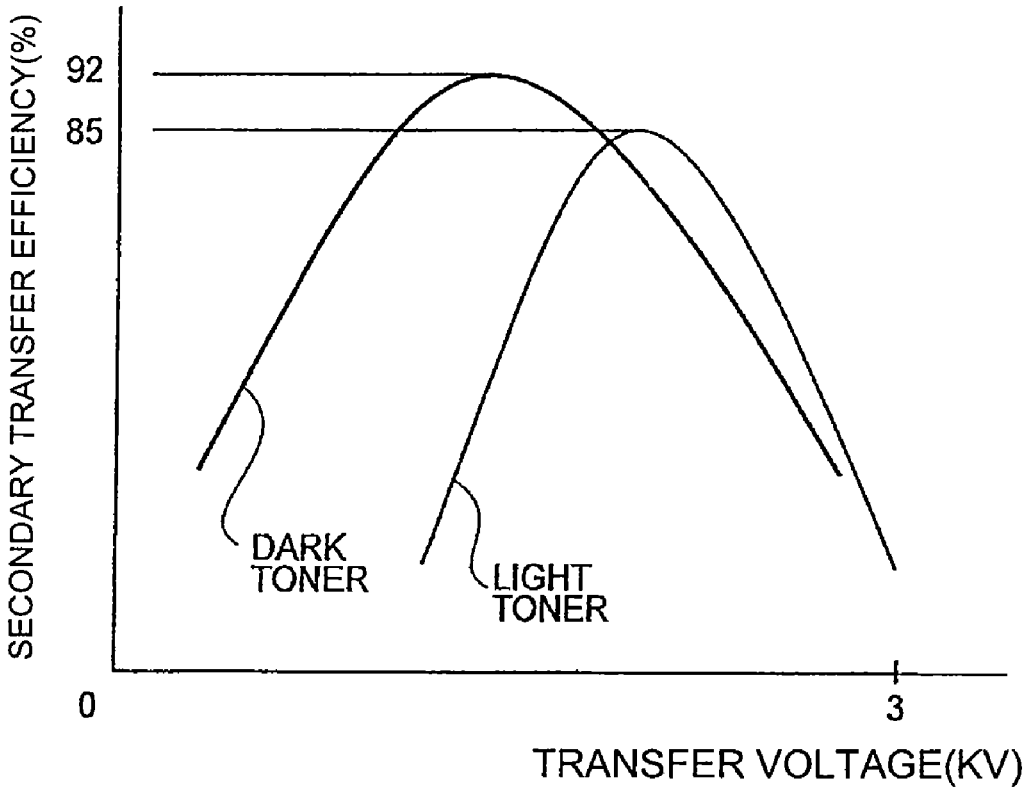
FIG. 3 is a graph for illustrating a secondary transfer characteristic in the First Embodiment of the present invention.

Secondary transfer characteristics of the dark color toner and the light color toner are shown in FIG. 3, wherein a transfer efficiency curve of the dark color toner secondary-transferred from the intermediary transfer belt 24 onto the transfer material 27 is represented by a thick solid line and a transfer efficiency curve of the light color toner is represented by a thin solid line.

Figure 4:
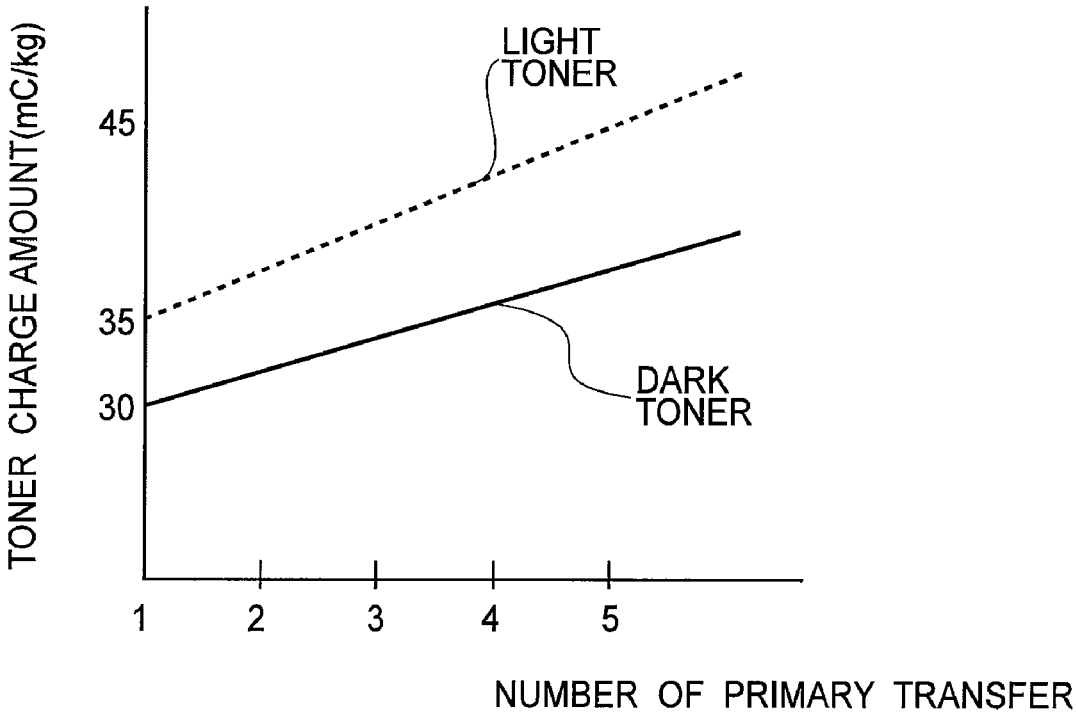
FIG. 4 is a graph for illustrating an increase in electric charge of toner with the number of transfer in the present invention.

As shown in FIG. 3, it has been found that the second transfer efficiency of the light color toner is considerably worse compared with that of the dark color toner. More specifically, it has been found that the toner image transferred onto the intermediary transfer belt 24 is increased in electric charge by the transfer current to be applied to the toner image at subsequent downstream image forming stations. For this reason, the light color toner images constituting the lower layer of first and second toner images on the intermediary transfer belt 24 in this embodiment are considerably decreased in secondary transfer efficiency. More specifically, progressions of triboelectric charges (amounts of electric charge) of the light color toner and the dark color toner on the intermediary transfer belt are shown in FIG. 4. Particularly, in the secondary transfer step in which many toner images are transferred onto the transfer material at one time, a latitude of transfer voltage setting is narrow, so that a difference in toner utilization efficiency is large depending on the kind of toner.

Figure 5:
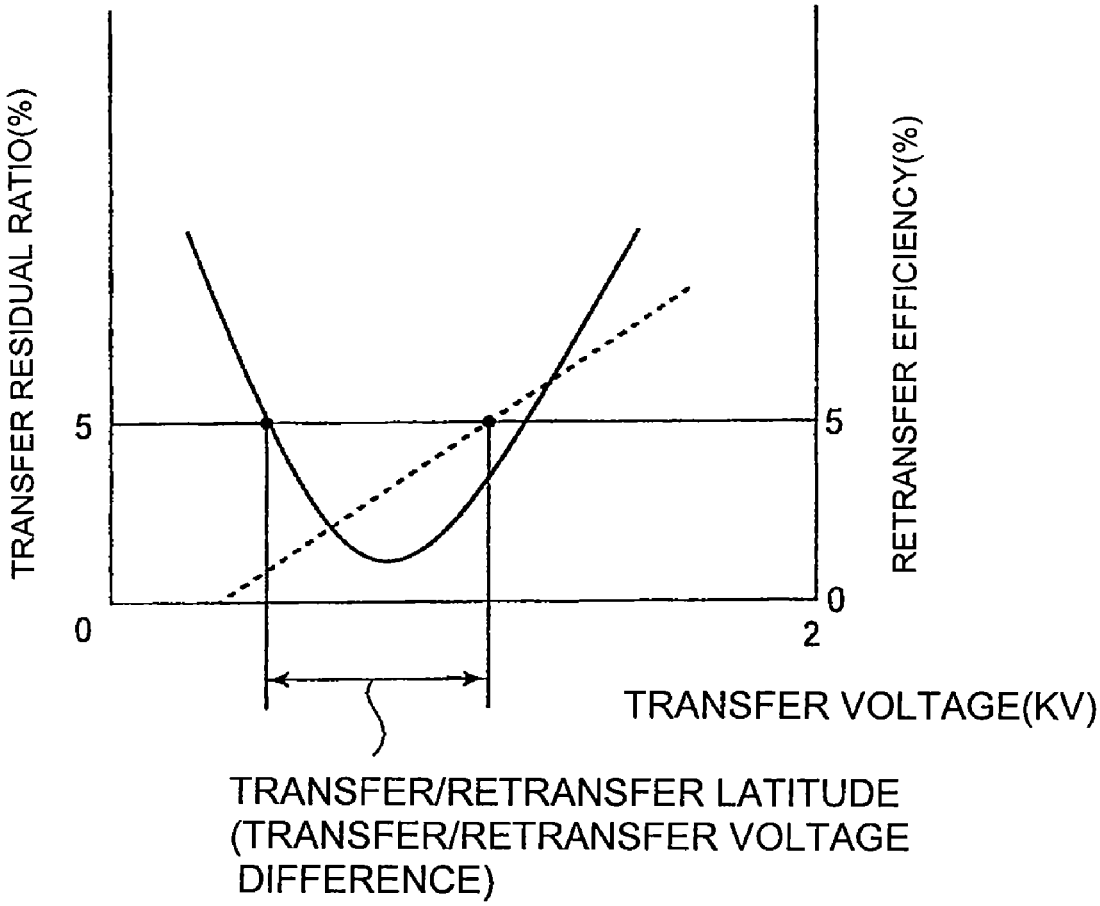
FIG. 5 is a graph for illustrating a latitude for transfer and retransfer in the First Embodiment of the present invention.

Further, in the transfer step, as described above, due to the changes in triboelectric charge of the toner and electric resistance of the transfer material caused by the charge in temperature and humidity, a discharge phenomenon is liable to occur to cause an abnormal image. For this reason, a transfer voltage setting not causing an abnormal image is required. Thus, it is necessary to provide not only an optimum transfer condition but also a transfer voltage latitude. In this embodiment, as shown in FIG. 5, a settable transfer voltage difference (Vd (T/RT)) between transfer and retransfer when a transfer residual ratio (%) and a retransfer efficiency (%) are not more than 5% is defined as a transfer/retransfer latitude (L (T/RT)).

Values of transfer/retransfer latitudes and secondary transfer efficiencies (Teff) of respective color toners are shown in Table 3.

TABLE 3

(conventionally transfer characteristics)

| Color toner | LM | LC | Y | M | C | K |
|---|---|---|---|---|---|---|
| Vd (T/RT) (volts) | 300 | 300 | 500 | 500 | 500 | 500 |
| (L(T/TR)) Teff (%) | 85 | 85 | 92 | 92 | 92 | 92 |

The above results in Table 3 are obtained under such a condition that the external additives for all the color toners have the same addition amount. More specifically, the inorganic fine particles (A) are added in an amount of 1.0 weight part and the inorganic fine particles (B) are added in an amount of 0.5 weight part.

In this embodiment, the addition amount of the inorganic fine particles (A), i.e., a toner coverage due to an external additive of the inorganic fine particles (A), externally added to each of the light color toners LM and LC is changed from 1.0 weight part to 5.0 weight parts to evaluate transfer characteristics. In this experiment, toner images are formed by using the above-described plurality of developing devices 1LM, 1LC, 1Y, 1M, 1C and 1K in this order. Further, with respect to each of the dark color toners 1Y, 1M, 1C and 1K, the inorganic fine particles (A) are added in an amount of 1 weight part (toner coverage due to an external additive of 12%) and the inorganic fine particles (B) are added in an amount of 0.5 weight part.

Figure 6:
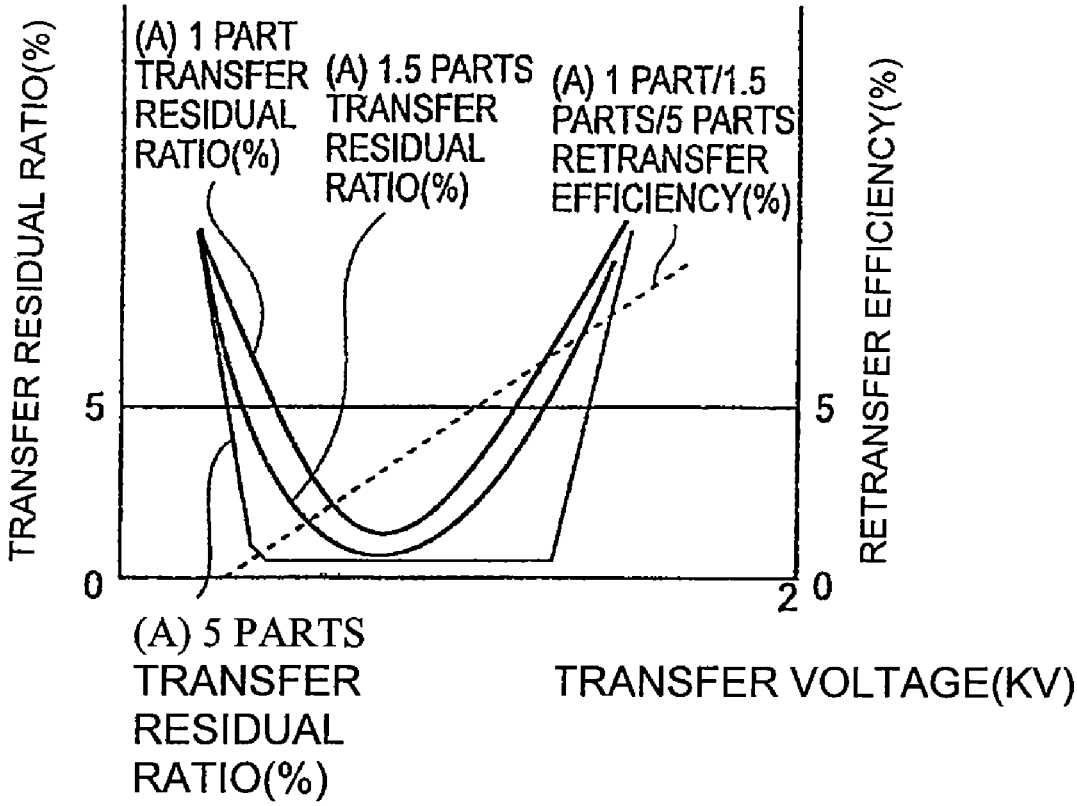
FIG. 6 is a graph for illustrating an effect of increase in an amount of inorganic fine particles (A) in the First Embodiment of the present invention.

FIG. 6 is a graph showing primary transfer efficiency characteristics in the case of increasing the addition amount of the inorganic fine particles (A) from 1.0 weight part to 5.0 weight parts.

As apparent from FIG. 5, by increasing the addition amount of the inorganic fine particles (A), it was possible to improve not only a maximum transfer efficiency but also rising and falling characteristics of transfer efficiency.

A relationship between the addition amounts of the inorganic fine particles (A) and toner coverage due to an external additive is shown in Table 4.

TABLE 4

(improved transfer characteristics 1)

| Amount (wt. part(s)) | 1.0 | 1.5 | 2.0 | 5.0 |
|---|---|---|---|---|
| Coverage (%) | 12 | 17 | 22 | 40 |

Figure 7:
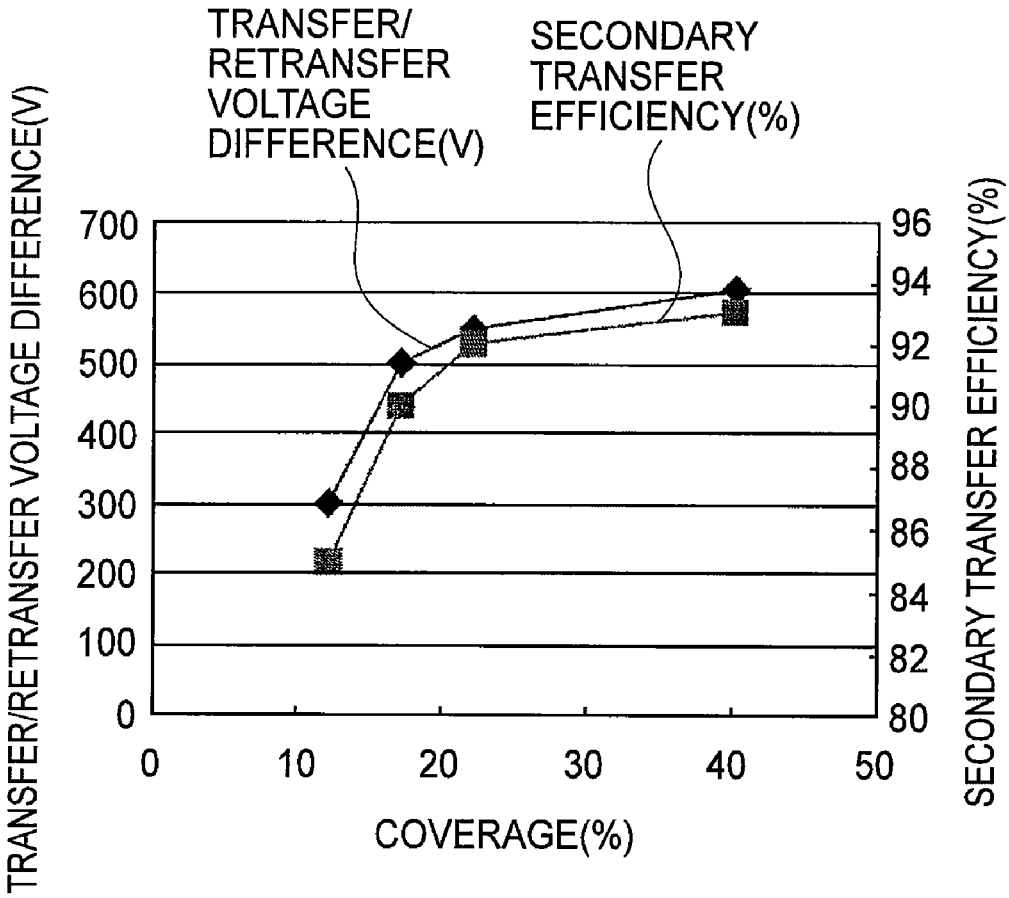
FIG. 7 is a graph for illustrating an improvement in transfer characteristic with respect to coverage of external additive.

Further, changes in transfer characteristic with respect to the toner coverage due to an external additive are shown in FIG. 7. As also apparent from FIG. 7, as a parameter affecting the transfer characteristics, the toner coverage due to an external additive of the inorganic fine particles (A) is more suitable than the addition amount of the inorganic fine particles (A).

When the addition amount of the inorganic fine particles (A) is not less than 2.0 weight parts, a flowability of toner is deteriorated to cause a poor developing characteristic and an occurrence of detachment of the external additive in some cases. This means that the toner coverage due to an external additive is not increased in proportion to the addition amount as shown in Table 4, so that the toner is not covered with the external additive and an amount of detachment is increased in the case of a large amount of the addition of the external additive. For example, when the addition amount of the inorganic fine particles (A) is increased up to 5.0 weight parts, the inorganic fine particles (A) are detached from the toner surface in an amount corresponding to the toner coverage due to an external additive of about 20%. In this embodiment, as the addition amount of the inorganic fine particles (A), 1.5 weight parts corresponding to the toner coverage due to an external additive of 17% which was most effective in improving the transfer characteristic is employed. More specifically, into the light color toners (1LM and 1LC) in this embodiment, the inorganic fine particles (A) is added in an amount of 1.5 weight parts (toner coverage due to an external additive of 17%) and the inorganic fine particles (B) is added in an amount of 0.5 weight part. As a result, compared with the conventional case, in this embodiment, it was possible to provide a transfer characteristic closer to that of the dark color toner, so that an effect of improving a stability in continuous use was able to be achieved.

From the above-described results, it was found that an appropriate range of the toner coverage due to an external additive for the light color toner is not less than 10% and not more than 40%.

The optimum amount of the external additive can be changed also with respect to the light color toners LM and LC by changing an external addition condition (such as rotation time or speed of stirring blade in an external addition apparatus) to improve a deposition performance on the toner (i.e., the toner coverage due to an external additive). In this case, however, it is necessary to pay attention since a flowability of toner is liable to be largely affected by, e.g., a degree of addition of the inorganic fine particles (B). Further, the above-described effect is somewhat improved in the case of changing the toner coverage due to an external additive but is smaller than that of the case of the inorganic fine particles (A). Further, the inorganic fine particles (B) are smaller in particle size than the inorganic fine particles (A), so that the flowability is considerably improved. As a result, toner scattering with respect to an image formed with a large amount of toner, such as secondary color line image, was caused to occur.

Second Embodiment

In the present invention, the toners used are not limited to those of magenta, light magenta, cyan, and light cyan. For example, in the case of using light black (LK) toner reduced in a coloring power compared with black toner or in a multi color image forming apparatus in which transparent toner, white toner and toner particular color such as blue, red or gold are contained, the present invention is effectively carried out. In these cases, an improvement in transfer characteristic was able to be achieved by employing such a constitution that toner coverage due to an external additive is lowered as the toner for development is changed from toner for a first image forming station to toner for a downstream image forming station.

Comparative Embodiment

In this comparative embodiment, in order to provide light color toners at first and second image forming stations and dark color toners thereat with the same triboelectric charge, TD ratios of the toners are adjusted. More specifically, by changing a TD ratio of the light color toners from 8% to 10%, the resultant triboelectric charge was 40 (mC/kg) which was substantially equal to that of the dark color toners. Results in the case where an addition amount of the inorganic fine particles (A) externally added into the light color toners LM and LC is 1.5 weight parts are shown in Table 5.

TABLE 5

(improved transfer characteristics 2)

| Amount of particles (A) | 1.5 wt. parts |
|---|---|
| Toner coverage due to an external additive | 17% |
| Transfer/retransfer voltage difference | 550 V |
| Secondary transfer efficiency | 92% |

As apparent from the results shown in Table 5, in this embodiment, it is possible to achieve the same effects as in the case of externally adding the inorganic fine particles (A) in an amount of 2.0 weight parts in Embodiment 1 while decreasing the addition amount of the inorganic fine particles (A) to 1.5 weight parts. Further, it was able to achieve a transfer/retransfer latitude larger than that in the case of the dark color toners.

A further improvement can be expected by increasing the TD ratio of the light color toners. However, in an actual study, the following problems were caused to occur. More specifically, in the case of continuously forming an image having a high image ratio (e.g., solid black image), stirring (contact) points of supplied toner and carrier charging sites cannot be sufficiently ensured. As a result, a background fog phenomenon due to stirring failure and a lowering in uniformity at a low density portion due to an excessively low triboelectric charge were caused to occur.

Accordingly, as in the present invention, the adjustment of the toner coverage due to an external additive of the inorganic fine particles (A) was able to provide an image capable of realizing most faithful reproducibility without being accompanied with the above described problems.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 251658/2005 filed Aug. 31, 2005, which is hereby incorporated by reference.

What is claimed is:

1. An image forming apparatus, comprising:

a first developing device for developing an electrostatic image with a first developer comprising a color toner and an external additive;

a second developing device for developing an electrostatic image with a second developer comprising the external additive and a transparent toner which has a charging characteristic such that a negative chargeability thereof is higher than that of the color toner; and a transfer apparatus for transferring toner images, which have been developed by said first and second developing devices, onto a transfer medium, wherein a toner coverage due to the external additive with respect to the transparent toner is larger than a toner coverage with respect to the color toner.

2. An apparatus according to claim 1, wherein the external additive comprises particles having an aspect ratio of not less than 1.0 and not more than 1.5 and a number average particle size of not less than 0.06 μm and not more than 0.3 μm.

3. An apparatus according to claim 1, wherein the toner coverage due to the external additive, with respect to each of the color toner and the transparent toner, of not less than 10% and not more than 40%.

4. An apparatus according to claim 1, wherein each of the first and second developers further comprises a second external additive, different from the first external additive, comprising particles having a number average particle size of not less than 0.01 μm and not more than 0.06 μm.

5. An apparatus according to claim 4, wherein the color toner and the transparent toner have a charging characteristic such that negative chargeability thereof is higher than that of the external additive and is lower than that of the second external additive.

6. An apparatus according to claim 4, wherein the first external additive and the second external additive have different charge polarities.

* * * * *